United States Patent [19]

Kimura

[11] 4,289,680

[45] Sep. 15, 1981

[54] HEAT RESISTANT AND FIRE-PROOF SYNTHETIC RESIN MATERIAL CONTAINING INORGANIC SUBSTANCES AND PROCESS OF PRODUCING SAME

[75] Inventor: Junichi Kimura, Higashine, Japan

[73] Assignee: Ishikawa Giken Kogyo Kabushiki Kaisha, Yamagata, Japan

[21] Appl. No.: 35,516

[22] Filed: May 3, 1979

Related U.S. Application Data

[63] Continuation-in-part of Ser. No. 464,195, Dec. 9, 1974, abandoned.

[51] Int. Cl.[3] ..... B32B 3/26; B32B 5/18; C08K 3/34

[52] U.S. Cl. ..... 260/37 R; 260/37 EP; 260/39 SB

[58] Field of Search ..... 428/446, 447, 921, 306, 428/313, 325, 329, 920, 310; 260/2.5 FP; 521/56

[56] References Cited

FOREIGN PATENT DOCUMENTS 1295279 11/1972 United Kingdom .

*Primary Examiner*—Thomas J. Herbert, Jr.
*Attorney, Agent, or Firm*—Fleit & Jacobson

[57] ABSTRACT

A heat resistant and fire-proof material comprising: (a) a thermosetting synthetic resin; and (b) a ceramic layer forming component comprising (1) boric acid salts and/or silicic acid salts, and (2) a filler material comprising expanded pearlite having the following characteristics: composition: 5 to 20% by weight of $Al_2O_3$, the balance being substantially $SiO_2$; specific gravity: 0.05 to 0.2; melting point: higher than 1000° C.; and thermal conductivity: 0.03 to 0.10 kcal/mh° C. The material has improved fire-proof and thermal insulation properties.

9 Claims, 11 Drawing Figures

FIG. 1(a)
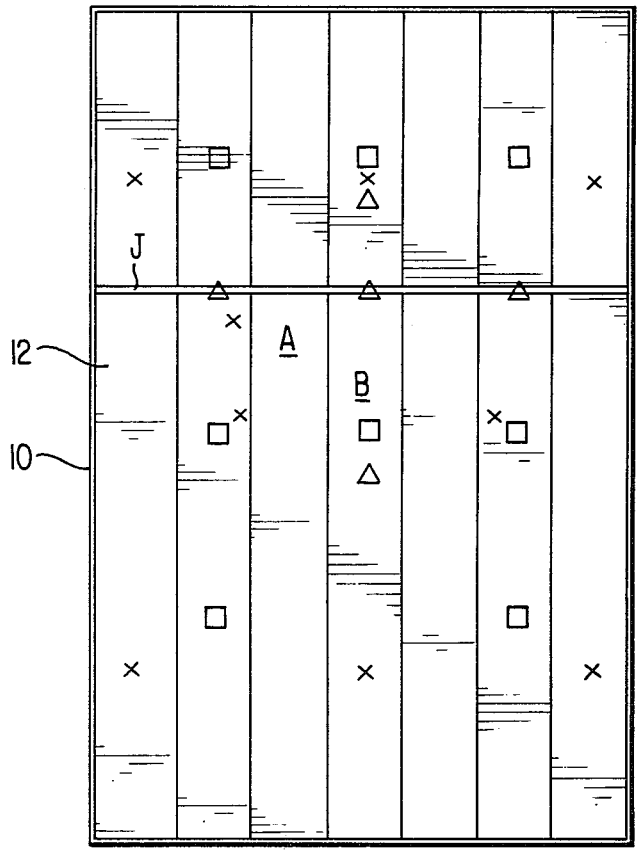
FIG. 1(b)
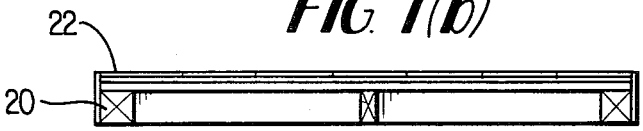
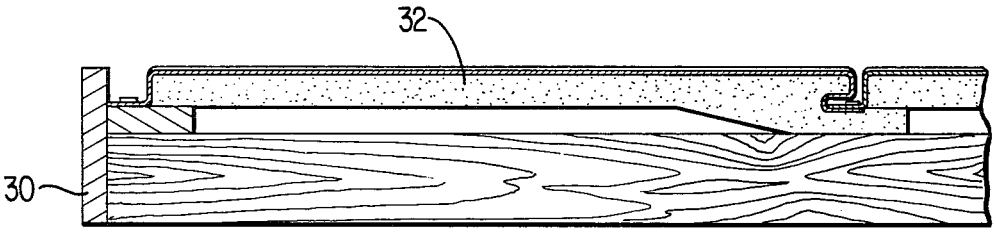
FIG. 1(c)

HEAT RESISTANT AND FIRE-PROOF SYNTHETIC RESIN MATERIAL CONTAINING INORGANIC SUBSTANCES AND PROCESS OF PRODUCING SAME

This application is a continuation-in-part application of U.S. application Ser. No. 464,195, filed Dec. 9, 1974 now abandoned.

BACKGROUND OF THE INVENTION

This invention relates to a novel heat resistant and fire-proof synthetic material. More specifically, this invention relates to a heat resistant and fire-proof synthetic resin composition which comprises a thermosetting synthetic resin and a ceramic layer forming component.

There are numerous known processes for producing foamed materials by adding a foaming agent to a suitable synthetic resin. Furthermore, various kinds of foaming agents for use in such processes are known.

Such artificial foam materials may be classified into those of the organic type which comprises organic high molecular weight compounds as the base, and the inorganic type. Examples of organic high molecular weight compounds include polyethylene, polystyrene and polyurethane. As to inorganic foam materials, examples include concrete and glass foams. It is noted that concrete foam has independent cells and comprises a double salt of a cement polymer and a silicon dioxide and aluminum hydroxide as a film former. This type of polymer possesses a characteristic different from that of the plastic foam. Glass foam is a refractory material produced by adding a small amount of powdered carbon black as a foaming agent to a mass of powdered glass, uniformly mixing the components, heating the mass in a mold for foaming, cooling slowly, and then withdrawing the product from the mold. In this case, antimony trioxide, potassium sulfate, or boric acid may be added in order to balance the sintering speed of the glass and the rate of foaming by smoothly carrying out the decomposition of the foaming agent. However, this process is applied only to the production of foamed materials consisting mainly of glass.

Processes for producing synthetic resin foams in which organic high molecular and light weight compounds having a particular molecular construction of straight or branched chains are reacted gradually with a polyisocyanate or boric acid are well known. However, these processes suffer from the disadvantage in that special equipment as well as specific techniques for pouring and foaming are required. Furthermore, these processes are usually difficult to control.

The use of synthetic resin foams as construction materials is widespread. For obvious reasons, it is desirable to impart excellent anti-flame properties at high temperatures in the foamed materials. However, synthetic resins generally have poor heat resistivity and weather durability, as compared with wood, metal and ceramics. Despite these disadvantages, various synthetic resin materials have been widely used due to the good plasticity thereof and many attempts have been made to further improve their physical properties.

With respect to anti-flame properties, synthetic resins are generally classified into two categories: difficultly inflammable type and incombustible type. A difficultly inflammable resin will continue to burn during contact with a flame so that it cannot be said to be the perfect fire-proof material. As to the incombustible type, such material will not burn by itself. Furthermore, incombustible materials can be classified into a self-extinguishing type which produces on the surface thereof an incombustible and heat resistant layer when contacted with an atmosphere of high temperature, and an incombustible type which is stable to heat due to a structure like an inorganic material although it comprises an organic substance as the main component.

SUMMARY OF THE INVENTION

According to the present invention, the material comprises a thermosetting synthetic resin; and a ceramic-layer forming component which comprises a boric acid salt and/or silicic acid salt, and a filler material comprising pearlite, the pearlite having the following characteristics.

(i) composition: from about 5 to about 20% by weight of $Al_2O_3$, the balance being substantially $SiO_2$;

(ii) bulk density: from about 0.05 to about 0.2 $gm/cm^3$;

(iii) melting point: higher than 1000° C.; and (iv) thermal conductivity: from about 0.03 to about 0.10 kcal/mh°C.

The present invention provides a novel material which can be considered to be an inorganic substance in which inorganic polymers or monomers are connected or in contact with the molecules of high molecular weight organic compounds. That is, the inorganic materials are not chemically reacted with the organic compounds. The present material is highly heat resistant and fire proof. In addition, the material is an excellent heat and sound insulator, and possesses high impact strength. Other characteristics of the present material include high water impermeability and long useful life. This material is useful in many fields of industry, such as the ceramic industry, including the manufacture of furnaces in which the material serves as a heat resistant ceramic carrier or coating material, an impregnating material and a bonding agent. The synthetic material of the present invention is also suitable as a material of fire-proof or refractory structure which is capable of being molded into a desired configuration such as a plate, especially for a light weight fire-proof material used in the construction of buildings.

This invention also provides a process of mixing components with one another by using a novel static mixer having spiral guide veins in which a synthetic resin foam material having a structure consisting of components interconnected with each other in a physical and chemical manner is produced.

BRIEF DESCRIPTION OF THE DRAWINGS

FIGS. 1*a*–1*c* illustrate the construction of the test sample;

DETAILED DESCRIPTION OF THE INVENTION

Figure 2:
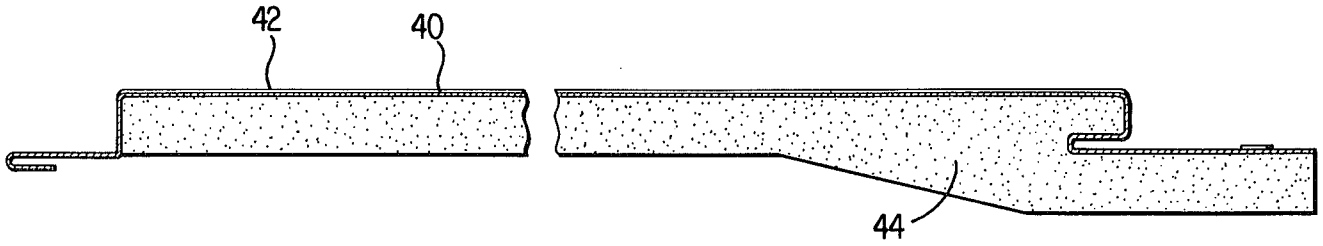
FIG. 2 illustrates the cross-sectional view of the test sample.
Figure 4:
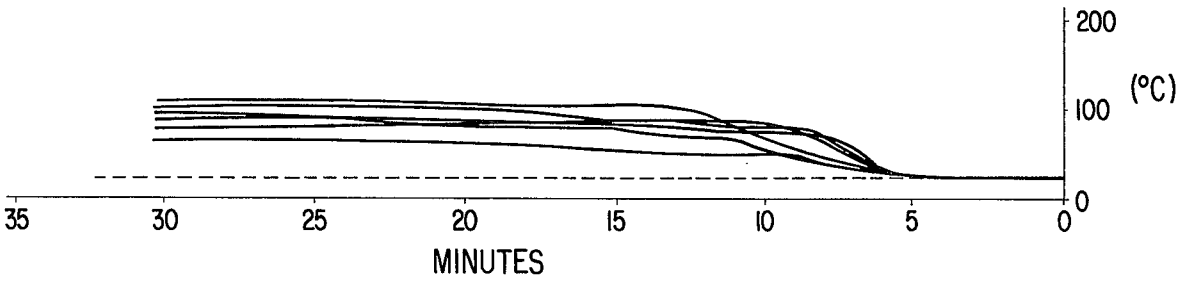
FIGS. 4 and 7 illustrate the temperature at the junction for the reverse side of the test sample as a function of time.
Figure 3:
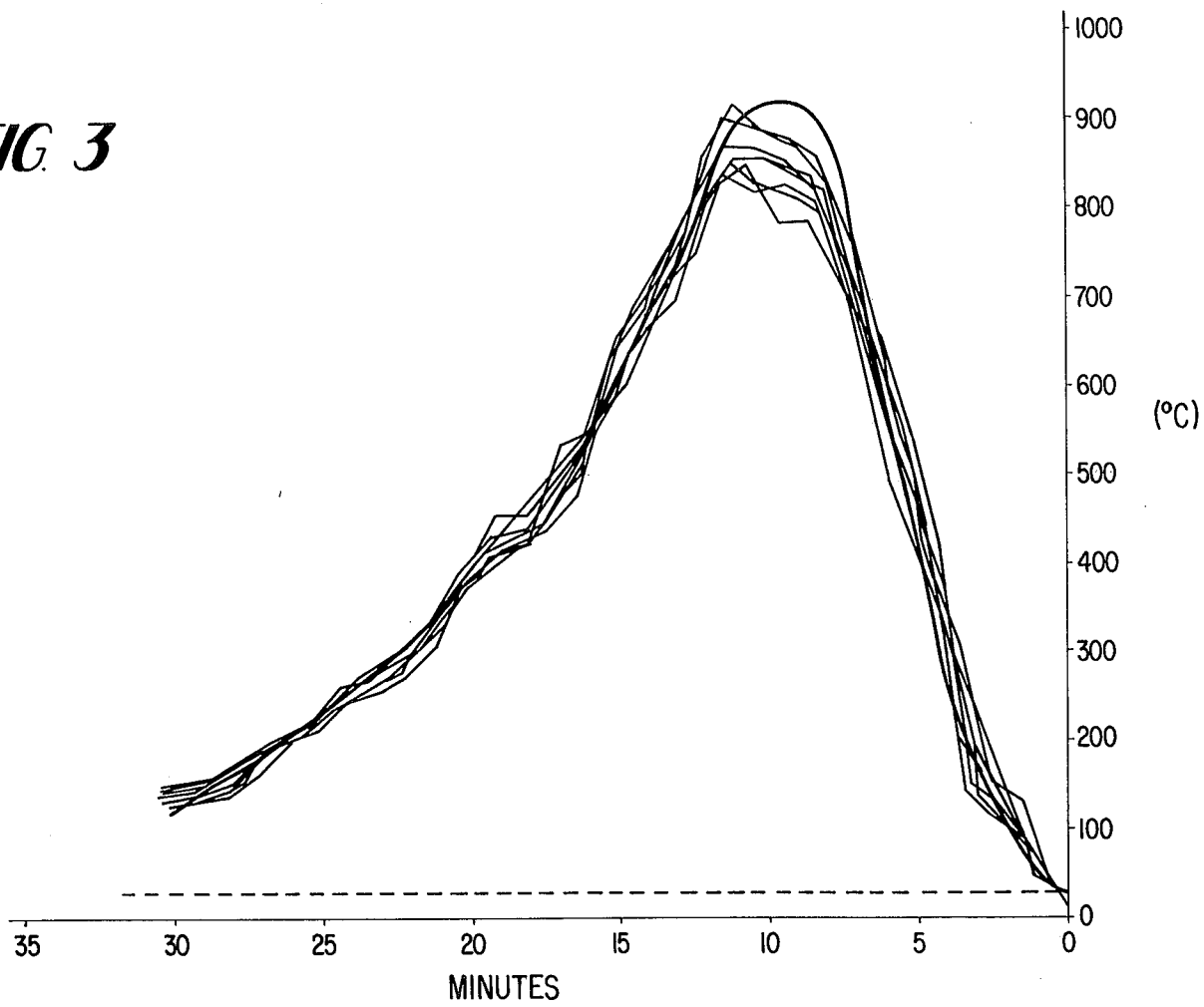
FIGS. 3 and 6 illustrate the temperature for the front side of the test sample as a function of time.
Figure 5:
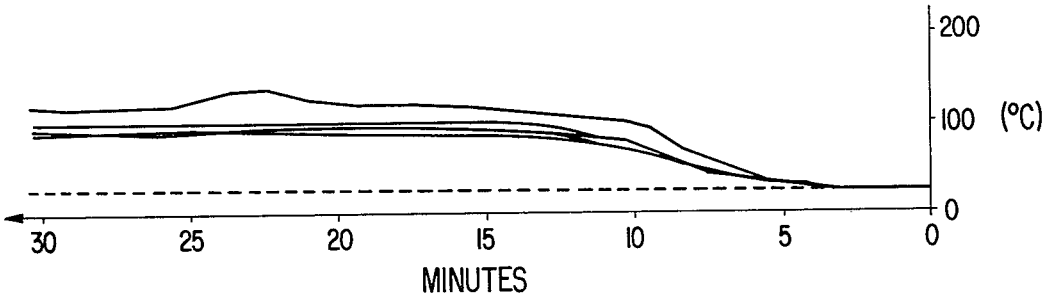
FIGS. 5 and 8 illustrate the temperatures at various locations on the reverse side of the test sample as a function of time.
Figure 7:
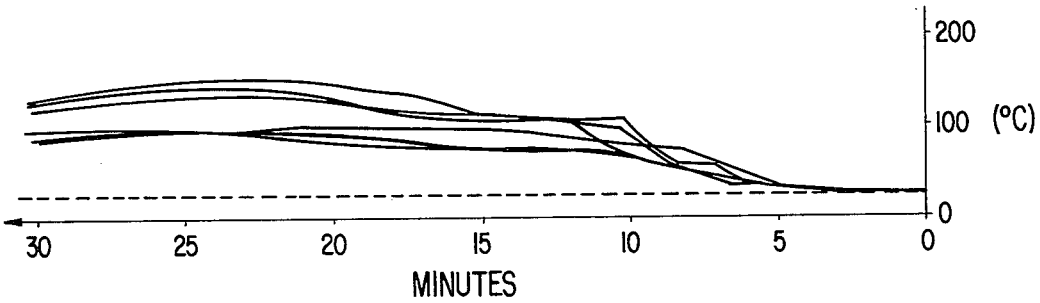
Figure 8:
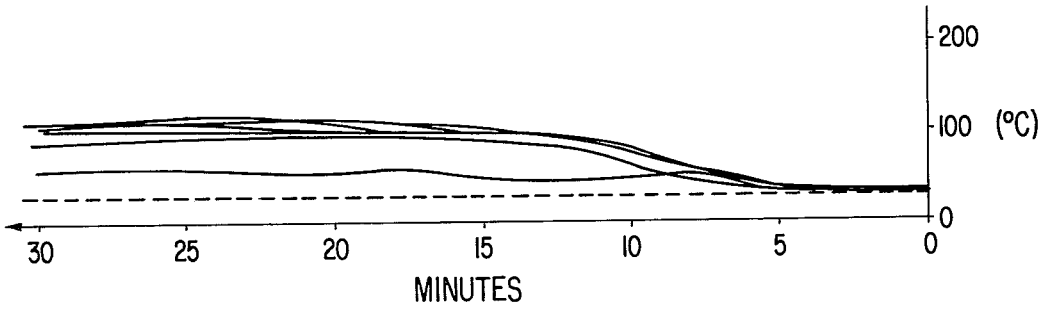
Figure 6:
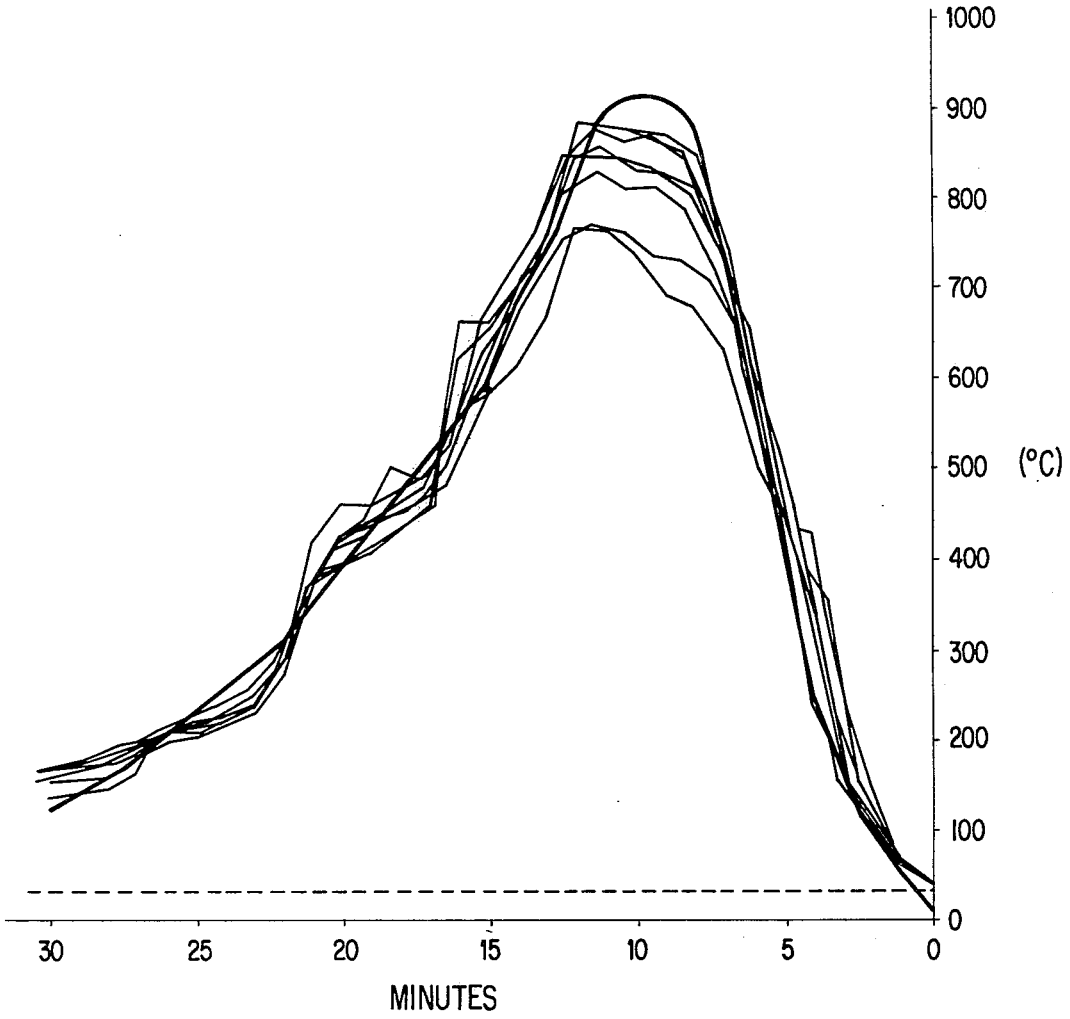

According to the present invention, there is provided a novel heat resistant and fire-proof synthetic resin material which comprises:

(a) a thermosetting synthetic resin; and (b) a ceramic layer forming component which comprises:

(1) a boric acid salt and/or silicic acid salt; and (2) a filler material comprising pearlite.

Specific thermosetting resins which may be used in the present invention include: melamine, urea, phenolic, epoxy, silicone, polyurethane, xylene, and toluene resins and the like. Among the above-listed thermosetting resins, polyurethane is preferred.

As to the boric acid salt and/or silicic acid salt, useful expands include the alkali metal salts, alkaline earth metal salts, and salts of such metals as copper and lead. Specific examples of such salts include the borates and silicates of sodium, potassium, calcium, magnesium, zinc, copper, and lead. Among the above-mentioned salts, alkali metal salts such as sodium borate and potassium borate are preferred.

The filler used in this invention is pearlite. It is emphasized that in order to attain the desirable results provided by this invention, the pearlite must possess the following characteristics:

(i) composition: from about 5 to about 20% by weight, preferably from about 6 to about 14% by weight of $Al_2O_3$, the balance being substantially $SiO_2$;

(ii) bulk density from about 0.05 to about 0.2 gm/cm$^3$, preferably from about 0.05 to about 0.07 gm/cm$^3$;

(iii) melting point: higher than 1000° C., preferably from about 1200° to about 1300° C.; and (iv) thermal conductivity: from about 0.03 to about 0.10 kcal/mh°C., preferably from about 0.03 to about 0.05 kcal/mh°C.

The amount of thermosetting resins in the material of the present invention ranges from about 30 to about 50% by weight, preferably 35 to 45%, most preferably 40% by weight.

The boric acid salt and/or silicic acid salt should be present in the material in an amount of from about 30 to about 60% by weight, preferably from about 45 to about 55% by weight, and most preferably about 50% by weight.

For the pearlite, this should be present in the material in an amount of from about 5 to about 30% by weight, preferably from about 7 to about 13% by weight, most preferably about 10% by weight.

The material of the present invention may further contain phosphoric acid or phosphates such as sodium phosphate, potassium phosphate, ammonium phosphate, calcium phosphate, magnesium phosphate, and aluminum phosphates, which when used in this invention, contain $AlPO_4$, $Al(H_2PO_4)_3$, and $Al(PO_3)_3$. The phosphate may be present in the material in an amount of from about 5% to 20% by weight, preferably from about 7 to about 15%.

The present material generally has a specific gravity of from about 0.15 to about 0.45, preferably from about 0.3 to 0.4, most preferably about 0.35. The water content in the material, after being heated for 48 hours at a temperature of 60° C., varies from about 3 to about 8% by weight, preferably from about 5 to about 6%. As can be seen from the specific gravity, the present material is light weight. It possesses excellent heat resistant, heat insulation and fire-proof characteristics. Furthermore, it has improved antidefacement and antishock properties, and increased hardness and dimensional stability. Accordingly, the present material may be made in the form of panels, plates, square or round timbers and laminated panel. Furthermore, the material may be used both in- or out-doors. For example, the present material may be laminated to a layer of aluminum foil for use as insulation for buildings. Alternatively, the material may be laminated to a thin sheet of aluminum or galvanized iron plate for use as sidings for houses.

According to the present invention, the fireproof material may be formed by thoroughly mixing the thermosetting resin with the ceramic layer forming component at a temperature of from about 15° to about 30° C. Thereafter, the mixture is poured into a mold and heated to a temperature of from about 40° to about 100° C., preferably from about 60° to about 80° C. for a period of from about 5 to about 30 minutes, preferably from about 15 to about 30 minutes. After it has cooled slowly, the molded article is taken out of the mold.

The present invention believes that the excellent antiflame ability exhibited by the present material is due to the fact that a ceramic layer is formed on the surface of the material when it is exposed to a temperature sufficiently high to cause the thermosetting resin to carbonize. The ceramic layer is formed as a result of the dehydration of boric and/or silicic acid salts. It is believed that the ceramic layer provides the excellent antidefacement and antishock properties as well as improved hardness and dimensional stability of the present material. When the material is heated to a high temperature so that the thermosetting resin undergoes thermal decomposition, the fire-proof property can still be maintained due to the fact that the boric and/or silicic acid or its derivatives generate gases by releasing its water of crystallization to combine with the particles of the material, thus filling up the spaces therebetween. The temperature of thermal decomposition of boric acid is 200° to 300° C. while the decomposition temperature of boric acid salts, such as sodium borate, copper borate, lead borate and zinc borate varies from about 300° to 700° C. For the above reasons, the present inventors believe that the present material possesses substantially improved heat resistant and fire-proof characteristics over those of the prior art. However, it must be noted that the present inventor offers the above mechanism merely as an explanation of the improved properties of the present material. Consequently, the present inventor does not wish to be bound by such explanation.

The present invention is further illustrated by the following examples. Such examples are merely for illustration purposes and should not be construed as limiting.

EXAMPLE 1

45 parts, by weight, of polyurethane, 15 parts of pearlite, and 40 parts of sodium borate were mixed well at 20° C. and poured into a mold. The pearlite has the following characteristics:

(i) composition: 10% by weight of $Al_2O_3$;

(ii) bulk density: 0.05 gm/cm$^3$;

(iii) melting point: 1300° C.; and (iv) thermal conductivity: 0.03 kcal/mh°C.

The mixture was then heated to 80° C. for a period of 30 minutes to cause foaming. After the foam had cooled off, it was removed from the mold. The foam had a density of 0.03 gm/cm$^3$.

EXAMPLE 2

50 parts by weight of polyurethane, 20 parts by weight of pearlite, and 30 parts of sodium borate were mixed well at 20° C. and poured into a mold. The pearlite has the following characteristics:

(i) composition: 10% by weight of $Al_2O_3$;
(ii) bulk density: 0.05 gm/cm$^3$;
(iii) melting point: 1300° C.; and
(iv) thermal conductivity: 0.03 kcal/mh°C.

The mixture was then heated to a temperature of 80° C. for a period of 30 minutes to cause foaming. The foam was then allowed to cool. The foam so obtained had a density of 0.20 gm/cm$^3$.

EXAMPLE 3

40 parts by weight of polyurethane, 10 parts pearlite, and 50 parts sodium borate were well mixed at 30° C. and poured into a mold. The pearlite has the following characteristics:

(i) composition: 10% by weight of $Al_2O_3$;
(ii) bulk density: 0.07 gm/cm$^3$;
(iii) melting point: 1300° C.; and
(iv) thermal conductivity: 0.05 kcal/mh°C.

The mixture is then heated to a temperature of 80° C. for a period of 30 minutes to initiate foaming. The foam so-obtained has a density of 0.35 gm/cm$^3$.

EXAMPLE 4

Two samples of the foam material A and B, prepared in accordance with Example 3 were tested for its heat and impact resistances. The test procedure was the same as outlined in JIS A 1301 (1959). The samples were laminated, on one side, to a pre-coated galvanized iron sheet having a thickness of 0.3 mm. The other side of the sample was bonded to an aluminum-paper laminate, with the aluminum being the outermost layer. The exterior surface of the galvanized iron sheet is provided with a lithin finish 0.7 mm thick. The samples were mounted on a wooden frame.

FIG. 1(*a*) illustrates the top view of the test sample which comprises sheets of the heat resistant and fireproof material of this invention 12 mounted on a wooden frame 10, 2700 cm by 1800 cm. In FIG. 1(*a*), the symbol X represents points where temperature readings are made, □ where temperature readings are made on the reverse side of the sample, i.e. nonheated side, and Δ where temperature readings are made on the reverse side along junction J where two pieces of the materials are jointed. Locations A and B are the impact test and deflection test points. FIG. 1(*b*) shows the front view of the sample, wherein 20 is the wooden frame and 22 is the siding material formed in accordance with the present invention. FIG. 1(*c*) shows the cross-sectional view of the test sample, with 30, the wooden frame, and 32 being the siding material of this invention. FIG. 2 shows a detailed cross-sectional view of the present siding material wherein 40 is the galvanized metal sheet, 42 is the lithin portion and 44 is the synthetic foam material of this invention.

The lithin sides of the samples were exposed to a light oil flame. The heating temperature was raised to 75° C. after 2 minutes of heating and thereafter increased to the maximum temperature of about 900° C. after 10–12 minutes of heating. The temperature was then gradually decreased as a function of time so that 30 minutes after the heating began, the heating temperature was at about 150° C. The temperature of various locations on the heated side and the reverse side of the sample were recorded by means of thermocouples (FIGS. 1 and 2). The results of the heating tests are shown in FIGS. 3–8 and Table 1.

As can be observed from the data shown in the Figures, although one side of the board was exposed to temperatures in excess of 800° C., a temperature of about 100° was maintained on the reverse side. Thus, it is amply shown that the foam material is an excellent thermal insulator; i.e., a good heat resistor.

| | Sample A | Sample B |
|---|---|---|
| Max. Temp, heated side | 910° C. (at 11 min.) | 880° C. (at 12 min.) |
| Max. Temp, reverse side | 135° C. (at 23 min.) | 157° C. (at 23 min.) |
| Max. Deflection | 0.4 cm | 0.4 cm |
| Deformation, destruction or falling off | none | none |
| Harmful Smoke | none | none |
| Carbonized areas on reverse side | none | none |
| Flaming or falling off | none | none |

EXAMPLE 5

The product of Example 3 was subjected to an impact test. One sample (C) was used. In these tests, a weight of 1 kg was dropped onto the sample from a height of 1.5 m.

A dent of 22 mm in diameter and 2 mm in depth was obtained. However, this dent did not extend to the reverse side of the sample.

EXAMPLE 6

Figure 9:
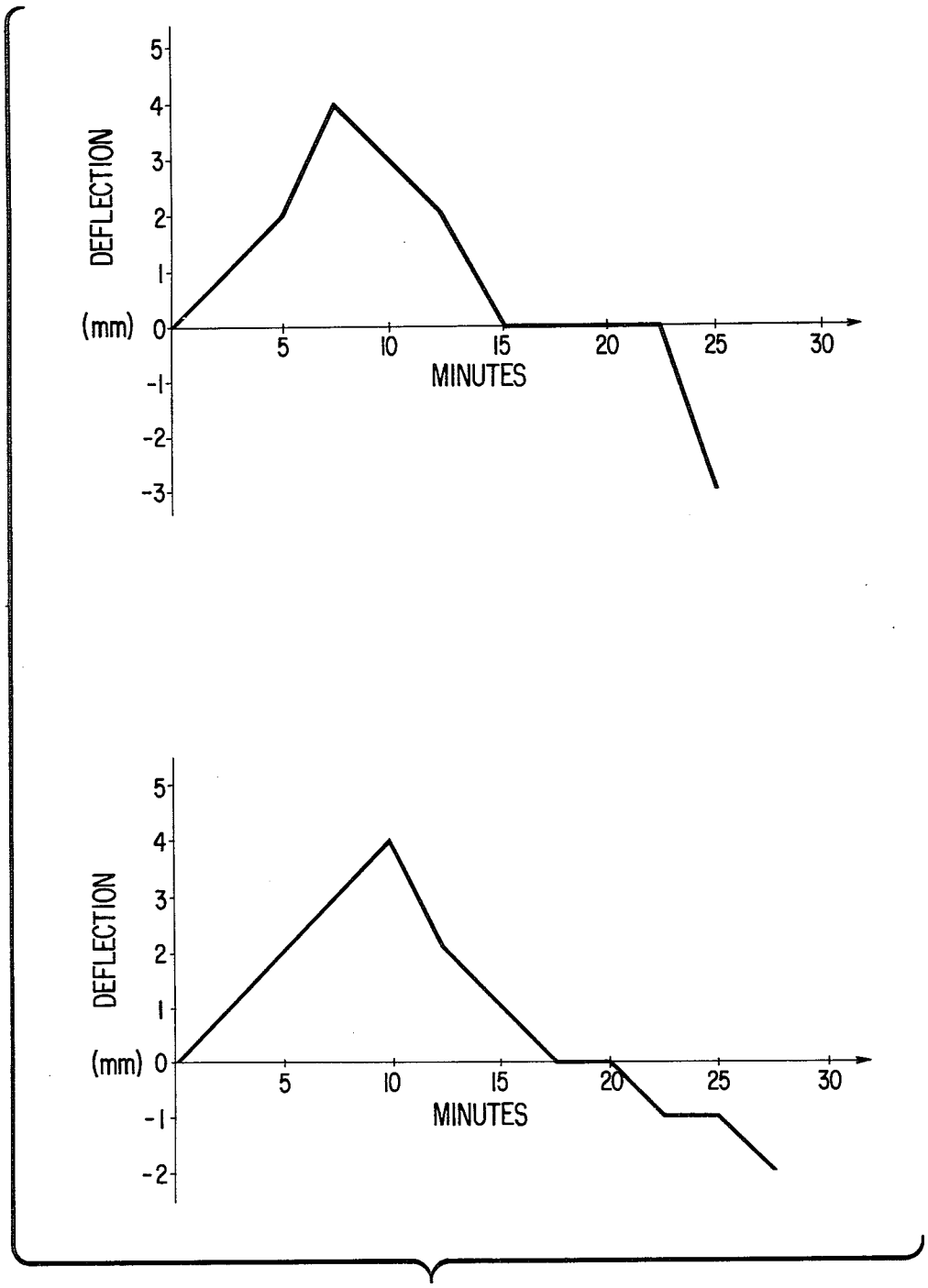
FIG. 9 illustrates deflections in the test samples resulting from heating as a function of time.

Deflections in the test samples resulting from heat were determined. In these tests, the sample was heated and observations were made at 5 min., 6 min., 9 min., and 16 min. for sample A and at 5 min., 6 min., 8 min., and 18-minute intervals for sample B, respectively. The results are summarized in Table 2 and FIG. 9.

TABLE 2

| Time after heating started | Observations |
|---|---|
| | Sample A |
| 5 min. | Small amount of vapor emitting from the junction position. |
| 6 min. | Large amount of vapor from the whole junction position. |
| 9 min. | Backing material began to melt. |
| 16 min. | A small amount of vapor is emitted. |
| | Sample B |
| 5 min. | Small amount of vapor is emitted from the entire junction position. |
| 6 min. | A large amount of vaper from the junction and water from the center of the junction position. |
| 8 min. | Backing material began to melt and |

TABLE 2-continued

| Time after heating started | Observations |
|---|---|
| | aluminum foil facing paper cracks. |
| 18 min. | A small amount of vapor is emitted |

What is claimed is:

1. A heat resistant and fire-proof material consisting essentially of:

(a) a thermosetting synthetic resin; and (b) a ceramic layer forming component consisting essentially of:

(1) at least one member of the group consisting of boric acid salts and silicic acid salts, and (2) a filler material consisting essentially of expanded pearlite, the pearlite having the following characteristics:

(i) composition: from about 5 to about 20% by weight of $Al_2O_3$, the balance being substantially $SiO_2$;

(ii) bulk density: from about 0.05 to about 0.2 gm/cm$^3$;

(iii) melting point: higher than about 1000° C. and (iv) thermal conductivity: from about 0.03 to about 0.10 kcal/mh°C.

2. The material of claim 1 wherein component (b)(2) has the following characteristics:

(i) composition: from about 6 to about 14% by weight of $Al_2O_3$, the balance being substantially $SiO_2$;

(ii) bulk density: from about 0.05 to about 0.07 gm/cm$^3$;

(iii) melting point: from about 1200° to about 1300° C.; and (iv) thermal conductivity: from about 0.03 to about 0.05 kcal/mh°C.

3. The material of claim 2 wherein the thermosetting synthetic resin is selected from the group consisting of melamine, urea, phenol, epoxy, silicone, polyurethane, xylene, and toluene resins.

4. The material of claim 2 wherein the salt of (b)(1) is selected from the group consisting of the salts of sodium, potassium, calcium, magnesium, zinc, copper, and lead.

5. The material of claim 2 wherein component (a) is present in an amount of from about 30 to about 50% by weight, component (b)(1) from about 30 to about 60% by weight, and component (b)(2) from about 5 to about 25% by weight.

6. The material of claim 2 which additionally includes phosphoric acid or a salt thereof.

7. The material of claim 2 wherein component (a) is polyurethane and is present in an amount of about 40% by weight; component (b)(1) is sodium borate and is present in an amount of about 50% by weight; and component (b)(2) is pearlite and is present in an amount of 10% by weight.

8. The material of claim 7 having a specific gravity of 0.55 and a water content of about 5.6% by weight, after heating at about 60° C. for about 48 hours.

9. A process of making a heat resistant and fire-proof material comprising:

(a) mixing intimately from about 30 to about 50% by weight of a thermosetting synthetic resin, from about 30 to about 60% by weight of at least one member of the group consisting of boric acid salts and silicic acid salts and from about 5 to about 25% by weight of expanded pearlite having the following characteristics:

(i) composition: from about 5 to about 20% by weight of $Al_2O_3$, the balance being substantially $SiO_2$;

(ii) bulk density: from about 0.05 to about 0.2 gm/cm$^3$;

(iii) melting point: higher than about 1000° C.; and (iv) thermal conductivity: from about 0.03 to about 0.10 kcal/mh°C.; and (b) heating the mixture to a temperature of about 80° C. for a period of about 30 minutes.

* * * * *